US006131672A

United States Patent [19]

Beccu et al.

[11] Patent Number: 6,131,672

[45] Date of Patent: Oct. 17, 2000

[54] PERCUSSIVE DOWN-THE-HOLE ROCK DRILLING HAMMER AND PISTON THEREFOR

[75] Inventors: Rainer Beccu; Matt Shofner, both of Alachua, Fla.; Kenneth Ahlhorn, Houston, Tex.

[73] Assignee: Sandvik AB, Sandviken, Sweden

[21] Appl. No.: 09/503,343

[22] Filed: Feb. 14, 2000

[51] Int. Cl.[7] ..... E21B 4/06

[52] U.S. Cl. ..... 173/91; 173/17; 173/78

[58] Field of Search ..... 173/91, 73, 78, 173/80, 135, 136, 15, 17; 175/296

[56] References Cited

U.S. PATENT DOCUMENTS

| | | | |
|---|---|---|---|
| 3,712,388 | 1/1973 | Curington | 173/78 |
| 4,015,670 | 4/1977 | Rear . | |
| 4,106,571 | 8/1978 | Stone | 173/73 |
| 4,446,929 | 5/1984 | Pillow | 173/17 |
| 4,790,390 | 12/1988 | Sweeny | 173/17 |
| 4,921,052 | 5/1990 | Rear | 173/78 |
| 4,923,018 | 5/1990 | Meek | 173/73 |
| 5,107,944 | 4/1992 | Gustafsson | 173/78 |
| 5,131,476 | 7/1992 | Harrington | 173/17 |
| 6,062,322 | 5/2000 | Beccu et al. | 173/78 |

FOREIGN PATENT DOCUMENTS 0 336 010 10/1989 European Pat. Off. .

*Primary Examiner*—Scott A. Smith

*Attorney, Agent, or Firm*—Burns, Doane, Swecker & Mathis, L.L.P.

[57] ABSTRACT

A down-the-hole percussive drill comprises a casing, a drill bit mounted at a lower end of the casing, a hollow feed tube fixed within the casing and extending along a center axis thereof, and a piston mounted for axial reciprocation within the casing for transmitting impacts to the drill bit. The upper portion forms a downwardly facing surface at the junction between the upper and lower portions. Passages for conducting lubricant-containing pressurized air are formed in the piston. At least one of those passages constitutes a vertical recess formed in the outer periphery of the piston. The piston includes a radially outwardly projecting rib disposed between upper and lower ends of the recess. Air is blocked from traveling past the rib until the rib becomes located opposite an annular groove formed in an inner surface of the casing.

6 Claims, 6 Drawing Sheets

FIG. 2A
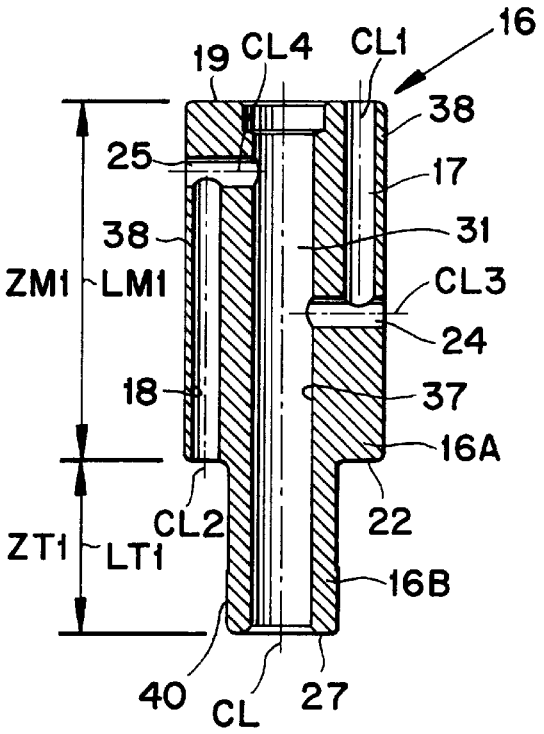
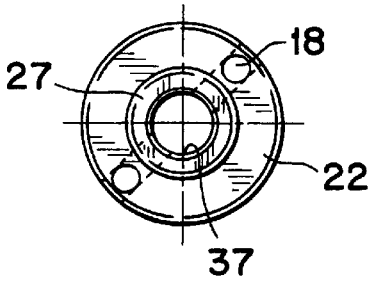
FIG. 2B
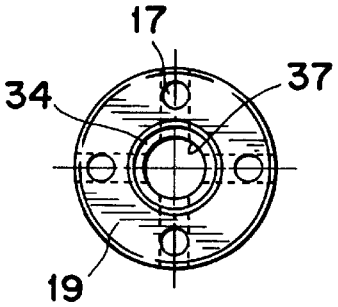
FIG. 2C
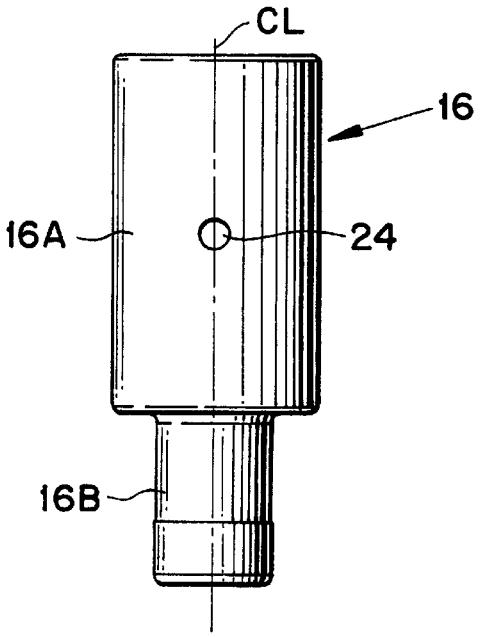
FIG. 2D

FIG. 3A
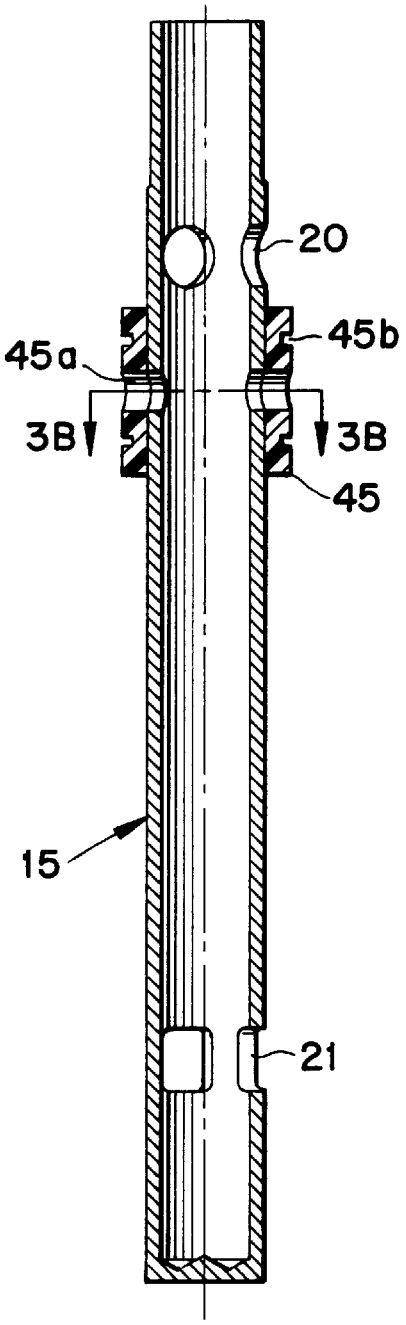
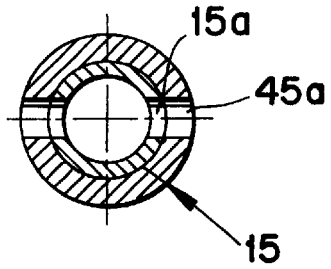
FIG. 3B
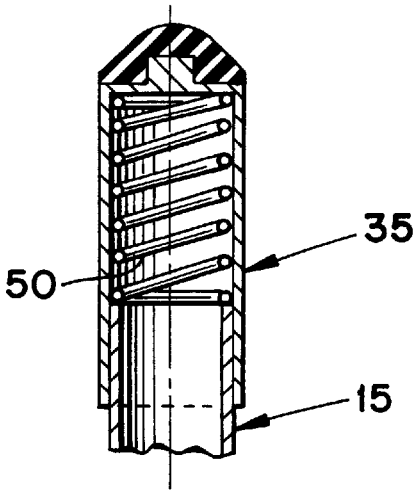
FIG. 4
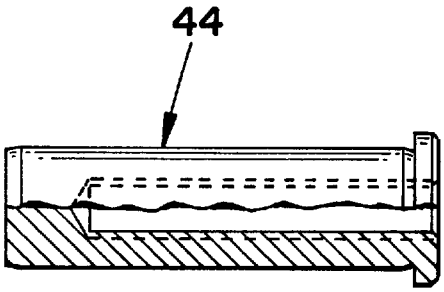
FIG. 5

FIG. 6
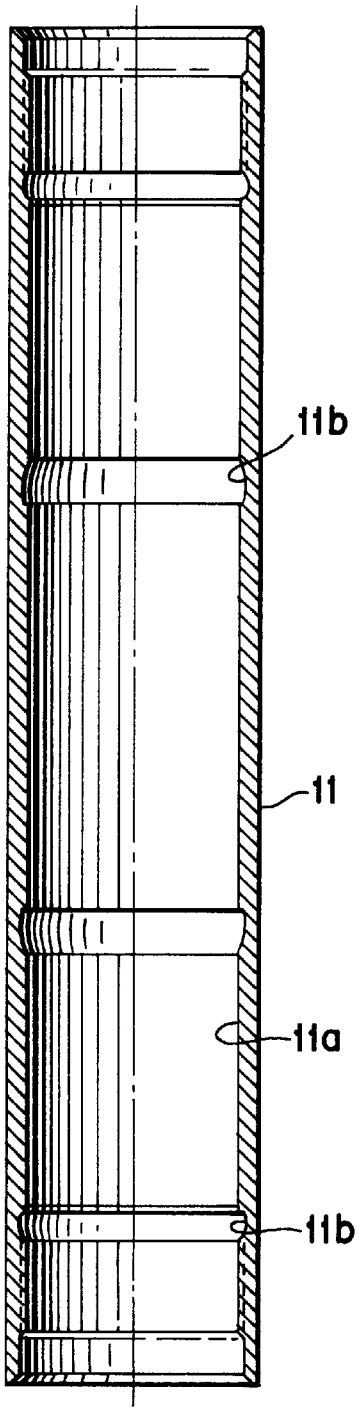
FIG. 7
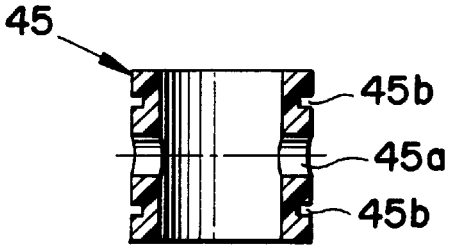
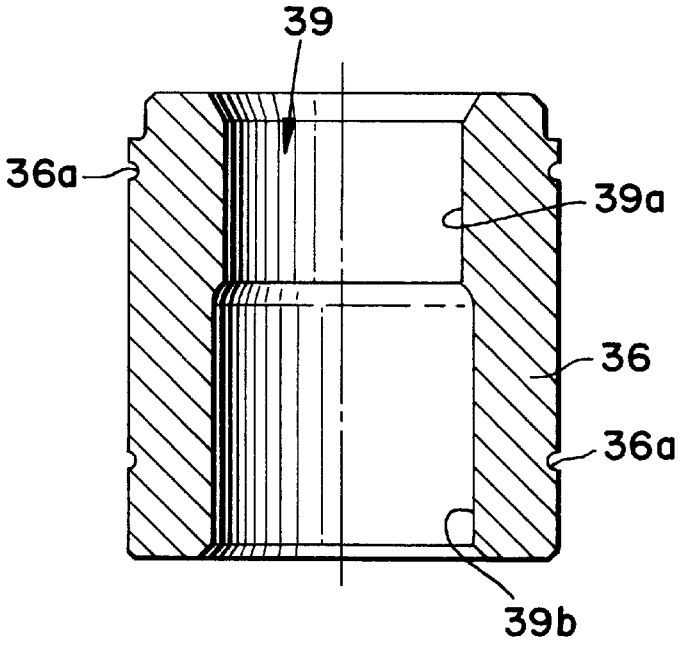
FIG. 8

FIG. 9
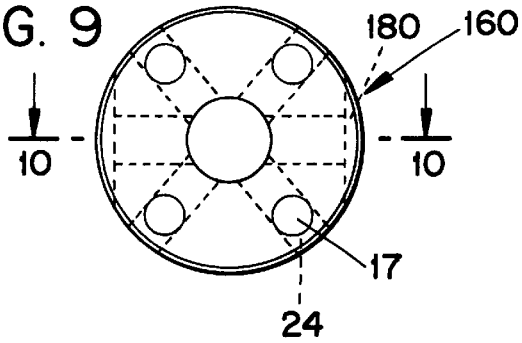
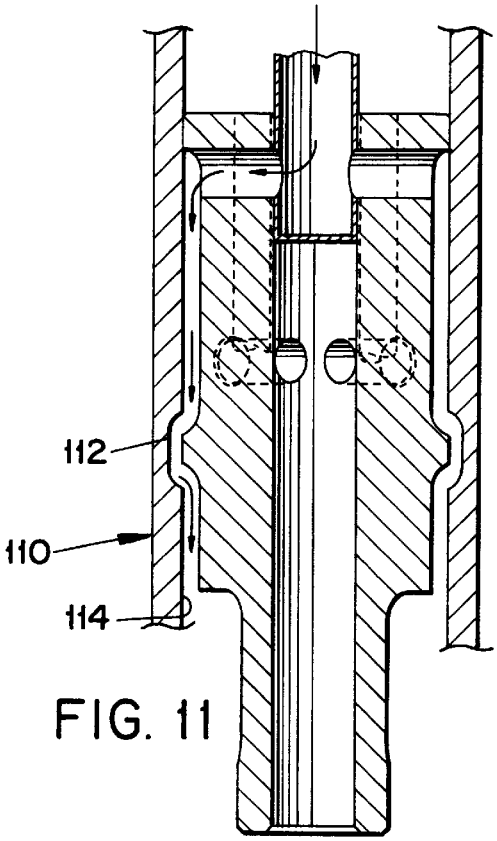
FIG. 11
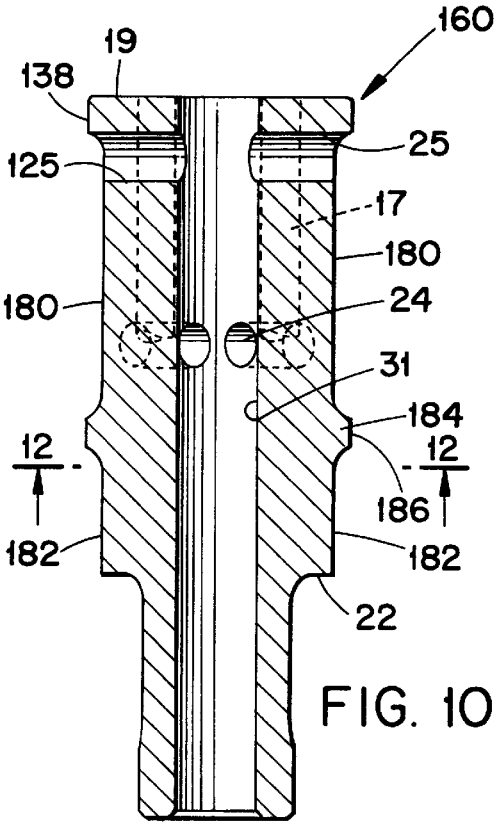
FIG. 10
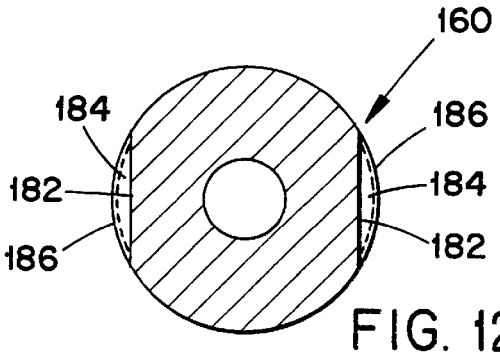
FIG. 12

PERCUSSIVE DOWN-THE-HOLE ROCK DRILLING HAMMER AND PISTON THEREFOR

RELATED INVENTION

This invention is related to that disclosed in U.S. Ser. No. 09/099,686, filed Jun. 15, 1998 and now U.S. Pat. No. 6,062,322.

TECHNICAL BACKGROUND

The present invention relates to a percussive down-the-hole hammer for rock drilling, and a piston used therein.

DESCRIPTION OF THE PRIOR ART

A prior art piston for a down-the-hole hammer is disclosed in European Document-B1-0 336 010. The piston comprises a central channel to which ducts are connected. The ducts provide air distribution to bottom and top chambers via peripheral grooves in the piston. The known piston is geometrically complex and is not constructed with regard to impedance. In addition, the known hammer has a reversible casing in which grooves for conducting working air are machined. That enables oil entrained in the air flow to reach the interface between the piston and the inner surface of the casing, to lubricate that interface. However, the presence of the air-conducting grooves in the casing serves to weaken the casing and make it difficult to manufacture. It would be desirable to provide a stronger casing which is relatively simple to manufacture, while still providing for lubrication of the interface.

Another prior art down-the-hole hammer is disclosed in U.S. Pat. No. 4,015,670 wherein the piston reciprocates on a hollow air-feed tube which extends through a center hole of the piston. The passages for conducting pressurized air from the air-feed tube to chambers above and below the piston, in order to effect reciprocation of the piston, are formed entirely in the piston. That is, some of the passages extend from the center hole to a top surface of the piston, and others of the passages extend from the center hole to a bottom surface of the piston. A problem occurring in connection with such an arrangement is that when the bottom surface of the piston strikes the drill bit, the ends of the passages located in the bottom surface become at least partially blocked by the drill bit. Also, the impacts may cause cracks to occur in the bottom surface around the passage ends.

A further shortcoming occurs in the above-mentioned hammer where the piston reciprocates on a hollow air-feed tube extending through a center hole of the piston. The feed tube is typically mounted to a top sub of the drill and supports a one-way valve capable of closing-off a center bore of the top sub through which the working air is conducted, in order to prevent water and other foreign matter from passing upwardly through the top sub during intervals when no pressurized air is flowing therethrough. Structures used to mount the feed tube can increase the height of the drill. In some cases, a pin is extended radially through the top sub and the feed tube at a location below the external screw thread of the top sub to secure the feed tube, but such a pin acts as a restriction diminishing the air conducting capacity of the feed tube. Also, it is necessary to manufacture the outer diameter of the feed tube with close dimensional tolerance relative to an inner diameter of the top sub to ensure that proper engagement takes place therebetween, to stabilize the feed tube and prevent working air from leaking around the outside of the feed tube. The need for such high precision manufacture adds considerably to the fabrication costs. It would be desirable to provide a feed tube and simplified mounting arrangement therefor.

Another object is to provide an efficient down-the-hole hammer which is relatively easy to manufacture, and which contains a minimum of parts.

A further object is to provide a piston for a down-the-hole hammer which provides good lubrication on cooperating surfaces.

An additional object is to provide a piston for a down-the-hole hammer which is economical to produce.

SUMMARY OF THE INVENTION

A first aspect of the present invention relates to a down-the-hole percussive drill for rock drilling. The drill comprises a generally cylindrical casing having an inner surface, and an annular groove formed in the inner surface and spaced from top and bottom ends of the casing. A bit-mounting structure is mounted in a lower portion of the casing and forms an upwardly open central passageway. A drill bit is mounted in the bit mounting structure and includes an anvil portion projecting upwardly into the central passageway of the bit mounting structure. A top sub is mounted in an upper portion of the casing, and a hollow feed tube is mounted to the top sub and extends downwardly along a longitudinal center axis of the casing. The feed tube defines a center passage adapted to conduct lubricant-containing pressurized air. The feed tube includes upper and lower radial apertures spaced axially apart. A piston is mounted for axial reciprocation within the casing and is disposed below the upper sub and above the bit mounting structure. The piston includes upper and lower portions, the lower portion being of smaller cross section than the upper portion whereby the upper portion forms a downwardly facing surface at a junction between the upper and lower portions. The piston includes an axial through-hole slidably receiving the feed tube, a first passageway extending downwardly from an upwardly facing surface of the piston, a second passageway extending upwardly from the downwardly facing surface of the upper portion of the piston, a third passageway extending from the axial through-hole to an outer peripheral side surface of the piston and intersecting a lower end of the first passageway, and a fourth passageway extending from the axial through-hole to the outer peripheral side surface of the piston and intersecting an upper end of the second passageway. The second passageway is defined by a recess formed in the outer peripheral side surface of the piston. An upper end of the recess is spaced downwardly from the upwardly facing surface. The outer peripheral side surface of the piston includes a radially outwardly projecting rib situated between the upper and lower ends of the recess. Each of the third and fourth passageways is arranged to make intermittent communication with the lower aperture of the feed tube during reciprocation of the piston for exposing an inner surface of the casing to lubricant-containing air. The rib is located radially opposite the groove when the lower aperture communicates with the fourth passageway to enable lubricant containing air to flow through the groove and across the rib from the upper end of the recess to the lower end thereof. The lower portion of the piston is arranged to travel downwardly into the central passageway of the bit mounting structure and strike the anvil portion of the drill bit, with the downwardly facing surface of the upper portion of the piston spaced above the drill bit and the bit-mounting structure.

Another aspect of the invention relates to the piston per se.

DESCRIPTION OF THE DRAWINGS

These and other objects of the present invention will become apparent from the following detailed description of preferred embodiments thereof in connection with the accompanying drawings, wherein:

FIG. 2A shows a piston according to the present invention in a longitudinal section.

FIGS. 2B and 2C show bottom and top views, respectively, of the piston of FIG. 2A.

FIG. 2D shows the piston according to the present invention in a side view.

FIG. 3A is a longitudinal sectional view of an air feed tube according to the present invention.

FIG. 3B is a cross sectional view taken along the line 3B—3B in FIG. 3A.

FIG. 4 is a longitudinal sectional view of an upper portion of the feed tube and a valve mounted hereon.

FIG. 5 is a partially broken-away view of a tube-mounting pin according to the present invention.

FIG. 6 is a longitudinal sectional view of a casing according to the invention.

FIG. 7 is a longitudinal sectional view of a nylon bushing according to the invention.

FIG. 8 is a longitudinal sectional view through a seal member according to the invention.

FIG. 9 is a top view of a second preferred embodiment of a piston according to the present invention.

FIG. 10 is a vertical sectional view taken along line 10—10 in FIG. 9.

FIG. 11 is a view similar to FIG. 10, and further showing a modified casing.

FIG. 12 is a cross-sectional view taken along the line 12—12 in FIG. 10.

DETAILED DESCRIPTION OF PREFERRED EMBODIMENTS OF THE INVENTION

Figure 1A:
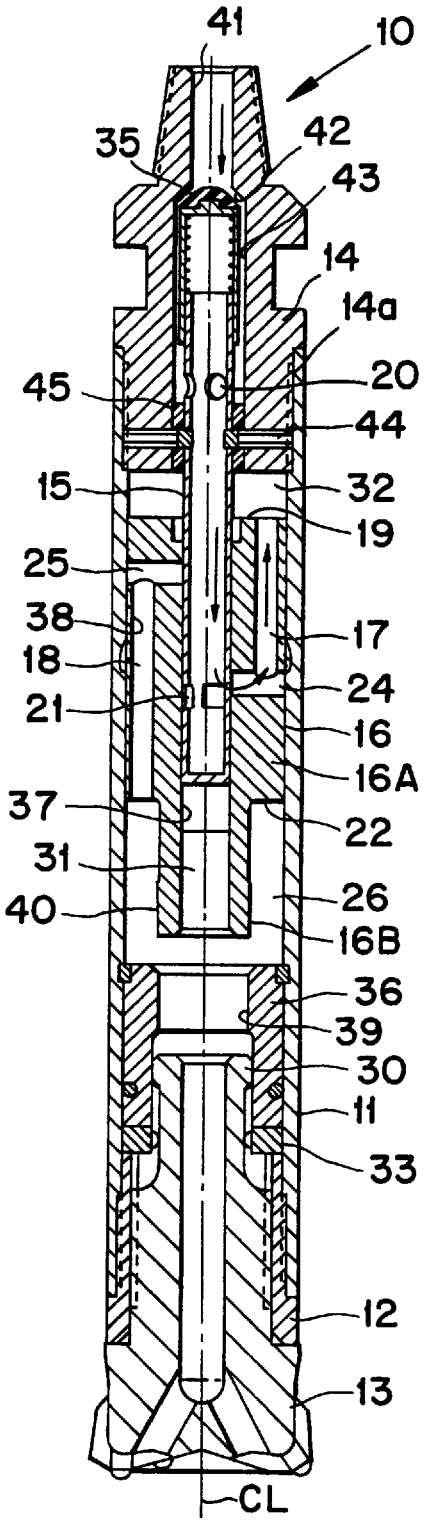
FIGS. 1A, 1B, 1C and 1D show a down-the-hole hammer according to the present invention in a longitudinal section in first, second, third and fourth positions, respectively.

In FIGS. 1A, 1B, 1C and 1D there is shown a preferred embodiment of a down-the-hole hammer 10 according to the present invention. The hammer 10 comprises a reversible outer cylindrical casing 11 which, via a top sub 14, is connectable to a rotatable drill pipe string, not shown, through which compressed air is conducted. The top sub has an external screw thread 14A connected to the casing 11. The inner wall of the casing 11 is free from air passage-defining grooves and is thus strong and relatively simple to manufacture. (Part-retaining grooves 11B may be provided in a portion of the inner wall in contact with the piston for retaining purposes only if a reversible casing 11 is used—see FIG. 6.) A hammer piston 16 reciprocates in the cylindrical casing 11, and compressed working air is directed alternately to the upper and lower ends of the piston to effect its reciprocation in the casing. Each downward stroke of the piston inflicts an impact blow upon the anvil portion 30 of a drill bit 13 mounted within a driver sub 12 at the lower portion of the cylindrical casing 11. As is evident from FIGS. 1A–1D the piston 16 and the drill bit 13 have a substantially reversed (inverted) shape relative to each other. That is, the piston has a wide upper portion and a narrow lower portion, and the drill bit has a wide lower portion and a narrow upper portion.

Generally speaking, when stress wave energy is transmitted through pistons and drill bits it has been found that the influence due to variations in the cross sectional area A, the Young's modulus E and the density ρ can be summarized in a parameter Z named impedance. The importance of impedance has been discussed in U.S. Pat. No. 5,305,841. The impedance $Z=AE/c$, where $c=(E/\rho)^{1/2}$, i.e., the elastic wave speed. Thus, $Z=2A\rho$.

The piston 16 according to the present invention (see FIGS. 2A–2D) includes a lower portion 16B, and an upper portion 16A which slidably engages the inner wall of the casing 11. The upper portion 16A has a length LM1 and an impedance ZM1, while the lower portion 16B has a length LT1 and an impedance ZT1. The relation ZM1/ZT1 is in the range of 3.5–5.8. Furthermore, the relation LM1/LT1 or TM1/TT1 is in the range of 1.0–3.0, preferably 1.5–2.5, where TM1 is the time parameter of the piston rear portion 16A and TT1 is the time parameter of the piston lower portion 16B. The definition of the time parameter T is $T=L/c$, where L is the length of the portion in question and c is the elastic wave speed in the portion in question. Thus, for the portion 16A, TM1=LM1/cM1; for the portion 16B, TT1=LT1/cT1. The reason why it is necessary to consider the time parameter T instead of the length L is that different portions may be formed of different materials that have different values regarding the elastic wave speed c.

Each of the portions 16A and 16B has a cylindrical basic shape and the lower, cylindrical portion 16B has a reduced diameter, thereby causing an intermediate end face or downwardly facing shoulder surface 22 to be formed on the upper portion 16A which surface is preferably perpendicular to the center line CL of the hammer. The construction of the piston is based on the idea that the mass distribution of the piston 16 is such that initially a smaller mass, i.e., the portion 16B, is contacting the drill bit 13. Subsequently, a larger mass, i.e., the portion 16A, follows. It has turned out that by such an arrangement almost all of the kinetic energy of the piston is transmitted into the rock via the drill bit.

An inner cylindrical wall 37 of the piston defines a central passageway 31 and is arranged to slide upon a coaxial control tube or feed tube 15 that is fastened to the top sub 14. The feed tube 15 is hollow and includes radial air inlet apertures 20 and radial air outlet apertures 21. The upper portion 16A of the piston is provided with several passageways 17, 18, 24 and 25 for the transportation of pressurized air. A first passageway 17 communicates with the upper end face 19 of the piston and opens into the wall 37 of the piston via a third passageway 24 at a location spaced along the length of the piston. A second passageway 18 in the piston communicates with the shoulder 22 and opens into the wall 37 of the piston via a fourth passageway 25 at a location spaced upwardly from the third passageway 24. Thus, the second passageway 18 does not open into either of the upper and lower faces 19, 27 of the piston. The passageways 17 and 18 are spaced radially from the outer periphery of the piston by a land 38 to strengthen the piston and to minimize air leakage. The centerlines CL1 and CL2 of the passageways 17 and 18, respectively, are substantially mutually parallel and substantially parallel to the centerline CL of the piston. The centerlines CL3 and CL4 of the passageways 24 and 25 are substantially mutually parallel and substantially perpendicular to the centerline of the piston. The diameters of the passageways 17, 24, 18 and 25 are substantially identical. The centerlines CL1 and CL3 of the passageways 17 and 24, respectively, preferably intersect one another, and the centerlines CL2 and CL4 of the passageways 18 and 25, respectively, also preferably intersect one another, for fatigue strength and blasting reasons.

The passageways 24 and 25 open into the cylindrical outer periphery of the piston which provides for a good lubrication of the sliding surfaces of the piston and facilitates the manufacture of the piston, such as the drilling and blasting steps. That is, oil that is entrained in the pressurized air will constantly be deposited on (and thus lubricate) the inner wall 11*a* of the casing even though the radially outer ends of the passageways 24 and 25 are substantially constantly sealed by said inner wall. The passageways 17 are spaced apart by about 90°, and the passageways 18 are spaced apart by about 180°.

There are depicted four first passageways 17 opening into the upper surface 19 (FIG. 2C) and only two second passageways 18 opening into the intermediate end face 22 (FIG. 2B). However, other combinations of passageways could be used, such as three first passageways and three second passageways, for example.

The lower portion 16B slides within a central passageway 39 of a bottom chamber seal member which rests upon retainers 33. The outer wall 40 of the lower portion 16B will slide against an inner wall of an upper portion 39*a* of the central passageway 39 to form a seal therebetween. The bottom chamber seal member 36 is of a generally cylindrical basic shape, and has grooves 36*a* for receiving O-ring seals which engage the inner surface 11A of the casing 11. The anvil portion 30 of the drill bit 13 is disposed within a lower, enlarged portion 39*b* of the central passageway 39. Thus, the seal member 36, together with the bottom sub 12, form a bit-mounting structure.

A bottom chamber 26 is continuously formed between the piston 16 and the seal member 36. During a downward stroke of the piston, the lower portion 16B of the piston reaches a position shown in FIG. 1B wherein the top of the central passageway 39 of the seal member 36 is closed. At that moment, the air outlet apertures 21 in the feed tube are also closed. Thus, the bottom chamber 26*a* is formed which is closed to the outside. Hence, the air in the bottom chamber begins to be compressed as the piston descends farther. Eventually, the piston strikes the drill bit 13 (see FIG. 1C), whereby a bottom chamber 26*b* is formed.

The pressurized air is constantly delivered to a central bore 41 of the top sub while the hammer is in use. The bore 41 connects to a conical valve seat 42 which in turn connects to an expanded center cavity 43. The feed tube 15 extends into the center cavity 43 of the top sub 14. A bushing 45 extends around a portion of the control tube 15 at a location below the air inlet 20 to stabilize the feed tube within the cavity. The bushing includes annular grooves 45*b* in an outer periphery thereof (see FIG. 7) for receiving O-ring seals which form a seal against the inner surface of the top sub. The bushing can be formed of any material, but preferably is formed of a light-weight material such as plastic (e.g., Nylon®) in order to minimize the weight acting on the pins 44 which are described below.

Due to the use of the bushing 45 to stabilize the feed tube, there is no need to fabricate the outer diameter of the feed tube with close dimensional tolerance relative to the inner diameter of the top sub, because the bushing ensures that the feed tube will be stabilized, and that no working air can leak downwardly past the bushing.

The feed tube is mounted to the top sub by means the two lateral pins 44 (see also FIG. 5), each extending through aligned radial bores formed in the lower portion of the top sub, the bushing 45, and the upper portion of the tube 15. The bores 15*a* and 45*a* formed in the control tube 15 and the bushing 45, respectively, are shown in FIGS. 3A and 3B. Each pin 44 extends from the tube 15 to the external screw threads 14*a* of the top sub, and does not extend into the interior of the tube to an appreciable extent, and thus does not diminish the air-conducting capacity of the tube as would occur if the pins extended completely through the tube. The upper portion of the tube 15 carries a check valve 35 which is resiliently arranged on the tube 15 by means of a coil compression spring 50 (see FIG. 4) which biases the valve closed during periods when the apertures 21 of the feed tube 15 are blocked by the inner wall 37 of the piston 16.

The hammer functions as follows with reference to FIGS. 1A to 1C. FIG. 1C shows the impact position of the piston 16. It should be noted that during a drilling operation the bottom chamber 26 disposed between the piston and the seal member 39 does not get any shorter than the length L2 of bottom chamber 26*b* shown in FIG. 1C. The forward end 27 of the piston has just impacted on the anvil portion 30 of the bit 13. A shock wave will be transferred through the bit to the cemented carbide buttons at the front surface of the bit, thereby crushing rock material. The hammer is simultaneously rotated via the drill string, not shown.

The piston will then move upwardly due to rebound from the bit and due to the supply of pressurized air from the air outlet apertures 21 of the control tube 15 via the passageways 25 and 18. The piston will close the apertures 21 while moving upwardly such that no more pressurized air will be emitted through the apertures 21. Accordingly, the spring 50 will push the valve 35 upwardly to a position closing the passage 41 (see FIG. 1B), since the air flow is blocked. The piston 16 is still moving upwardly due to its momentum and due to the expanding air in the bottom chamber. This piston movement will continue until the force acting downwardly upon the top surface 19 of the piston becomes greater than the force acting upwardly on the intermediate end face 22 of the piston. In the meantime, neither the top chamber 32 nor the bottom chamber 26 communicates with the supply of air or the outlet channels (see FIG. 1B).

Figure 1B:
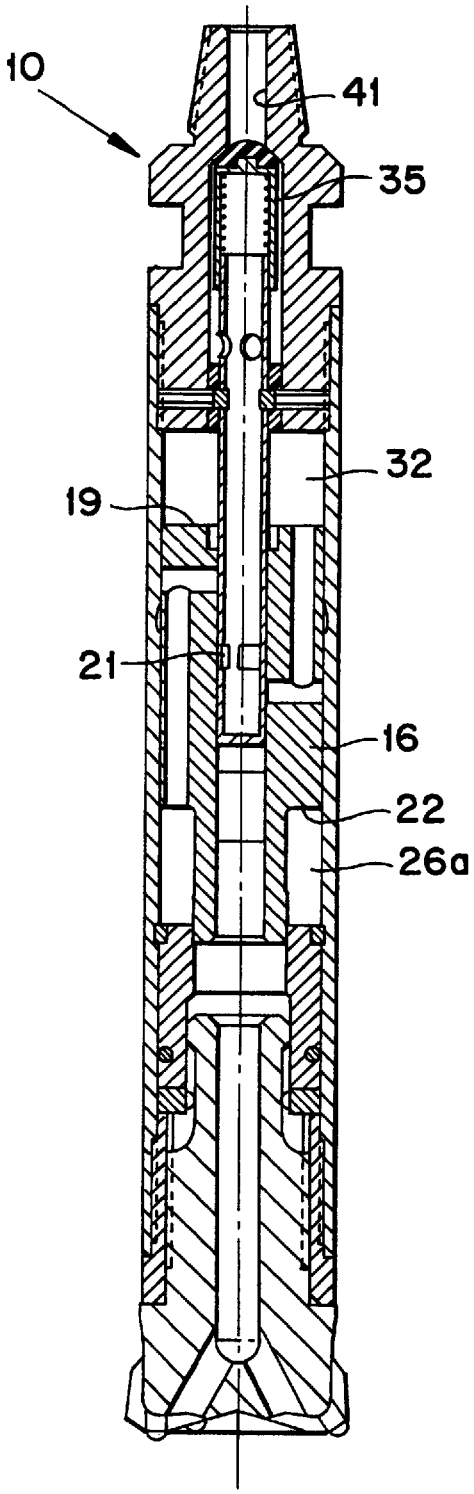
Figure 1C:
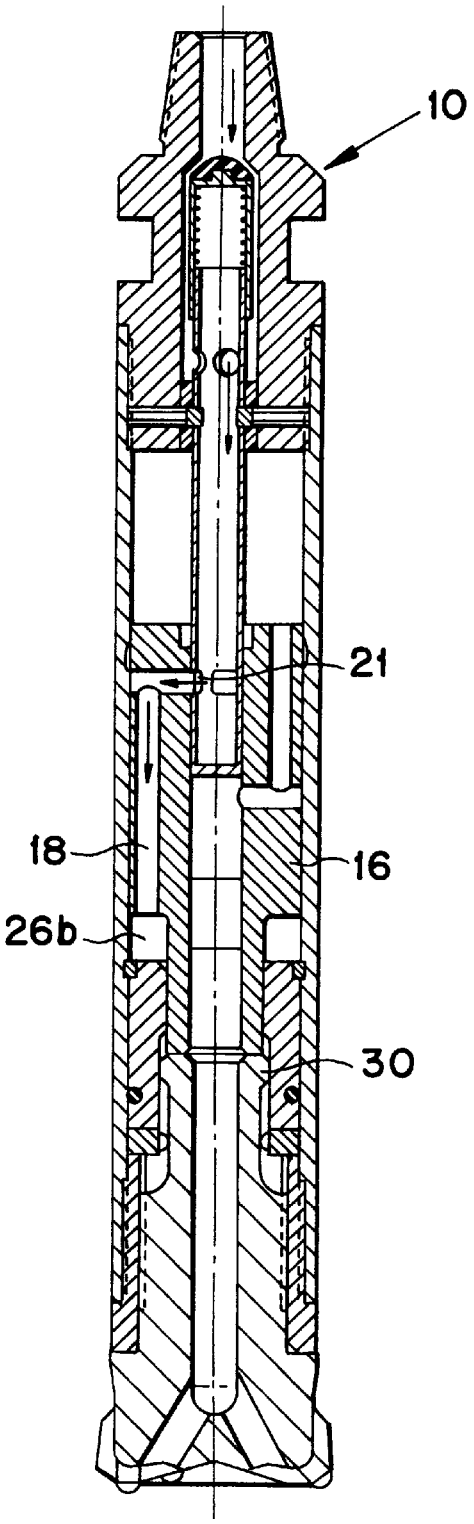

In the position shown in FIG. 1A the bottom chamber 26 has been opened to the exterior since the inner wall 39 of the bottom chamber seal member 36 and the outer wall 40 of the lower portion 16B no longer engage one another. Thus, the air will rush from the bottom chamber through the drill bit 13 for blowing away drill dust. The top chamber 32 is now supplied by pressurized air via the apertures 21 and the passageways 24, 17. The piston, however, is still moving upwardly such that eventually the apertures 21 become closed while the pressure of the compressed air in the closed top chamber 32 is boosted to a level about equal to the pressure of the supply air being delivered to the control tube 15. At this stage the piston stops its upward movement. A downward movement is then started due to the spring force of the compacted air in the closed top chamber 32. The downward movement is accelerated by air pressure added by the opening of the air supply to the top chamber 32 when the apertures 21 become aligned with passageway 24. The piston will continue its downward movement until the surface 27 of the elongated lower portion 16B impacts on the bit 13 as shown in FIG. 1C.

Figure 1D:
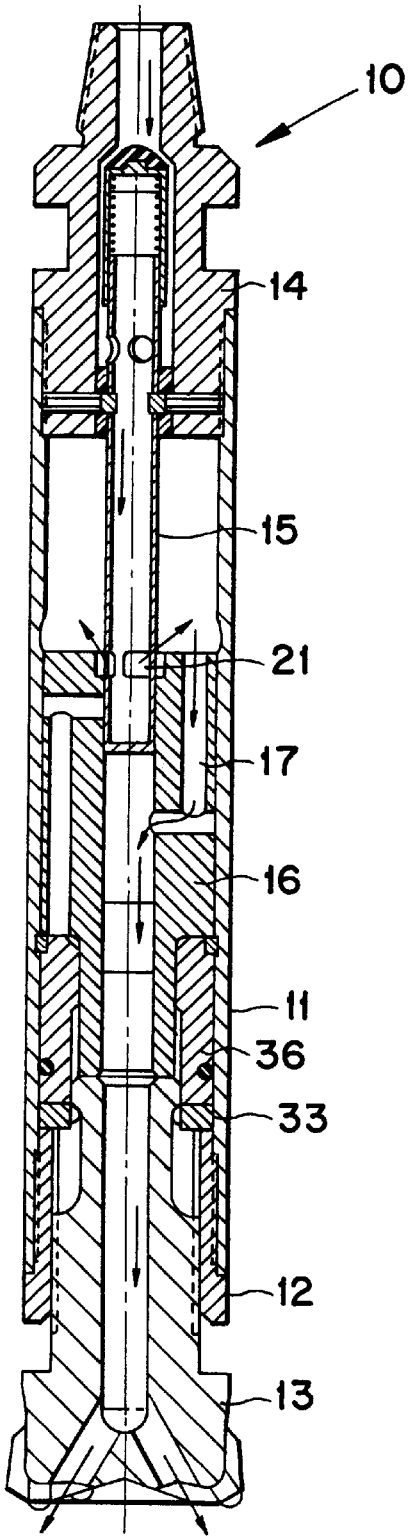

The above-described cycle will continue as long as the pressurized air is supplied to the hammer or until the anvil portion 30 of the drill bit comes to rest on the bit retainers 33 as shown in FIG. 1D. The latter case can occur when the bit encounters a void in the rock or when the hammer is lifted. Then, to avoid impacts on the retainers 33, the supply of air will not move the piston but will rather exit through the apertures 21 and follow the path indicated by the arrows in FIG. 1D to the front exterior of the hammer. However, when the hammer again contacts rock, the bit 13 will be pushed into the hammer to the position of FIG. 1C and drilling is resumed provided that pressurized air is supplied.

Tests have shown that the hammer according to the present invention drills 33% faster than the most competitive known hammer and it requires 15% less air consumption.

Further in accordance with the present invention the air-flow conducting passageways formed in the piston never become obstructed when the piston strikes the drill bit or the bit-mounting structure.

The mounting of the feed tube by pins extending through the threaded portion of the top sub reduces the height of the drill. Since the pins do not pass through the feed tube, they do not obstruct the air flow.

The use of a bushing between the feed tube and top sub enables the feed tube to be mounted in a stabilized manner without the need for its outer diameter to closely correspond dimensionally to the inner diameter of the top sub. Thus, the feed tube can be manufactured simply and less expensively.

An alternative embodiment shown in FIGS. 9–12 involves a piston 160 which is basically similar to that described in connection with FIGS. 2A–2D. However, the second passageways are not spaced from the outer peripheral side surface of the piston. Rather, each of the second passageways 180 is defined by a recess formed in the outer peripheral side surface 138 of the piston. Thus, there are two such recesses 180 arranged diagonally opposite one another. An upper end of each recess 180 is spaced downwardly from the upwardly facing surface 19. Each recess is formed by a secant 182 extending through the outer side surface 138 (see FIG. 12).

Disposed between upper and lower ends of recesses 180 is a radially outwardly projecting rib 184 that includes an outer face 186 which constitutes a continuation of the cylindrical outer surface of the piston.

The casing 110 is similar to the earlier described casing 11 except that it has an annular groove 112 formed in an inner surface 114 thereof. The groove 112 is arranged to become aligned with the rib 184 when the air outlet apertures 21 of the feed tube 15 are aligned with the fourth passageways 25, whereby air is able to flow around the rib 184 and reach the bottom chamber 26.

The embodiment disclosed in connection with FIGS. 9–12 maximizes the advantages achieved by the earlier embodiment disclosed in connection with FIGS. 1A–8 in that more lubricant-containing air will flow along the outside of the piston and lubricate the inner surface 114 of the casing 110, since the entire length of each of the recesses 180 communicates with the inner surface 114. Thus, better lubrication occurs. Also, any weakness present in the piston of FIG. 2A due to the thinness of the wall structure separating the second passageways 18 from the outer periphery of the piston is avoided in the piston of FIGS. 9–12, because such wall structure has been eliminated.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A down-the-hole percussive drill for rock drilling, comprising:

a generally cylindrical casing having an inner surface, an annular groove formed in the inner surface and spaced from top and bottom ends of the casing;

a bit-mounting structure mounted in a lower portion of the casing and forming an upwardly open central passageway;

a drill bit mounted in the bit-mounting structure and including an anvil portion projecting upwardly into the central passageway of the bit-mounting structure;

a top sub mounted in an upper portion of the casing;

a hollow feed tube mounted to the top sub and extending downwardly along a longitudinal center axis of the casing and defining a center passage adapted to conduct lubricant-containing pressurized air, the feed tube including upper and lower radial apertures spaced axially apart; and a piston mounted for axial reciprocation within the casing and disposed below the upper sub and above the bit-mounting structure, the piston including upper and lower portions, the lower portion being of smaller cross section than the upper portion whereby the upper portion forms a downwardly facing surface at a junction between the upper and lower portions, the piston including:

an axial through-hole slidably receiving the feed tube, a first passageway extending downwardly from an upwardly facing surface of the piston and spaced radially inwardly from an outer peripheral surface of the piston, a second passageway extending upwardly from the downwardly facing surface of the upper portion of the piston, wherein the second passageway is defined by a recess formed in the outer peripheral side surface of the piston, an upper end of the recess being spaced downwardly from the upwardly facing surface, a third passageway extending from the axial through-hole to the outer peripheral side surface of the piston and intersecting a lower end of the first passageway, and a fourth passageway extending from the axial through-hole to the outer peripheral side surface of the piston and intersecting an upper end of the second passageway, the outer peripheral side surface including a radially outwardly projecting rib situated between the upper end and a lower end of the recess, each of the third and fourth passageways arranged to make intermittent communication with the lower aperture of the feed tube during reciprocation of the piston for exposing an inner surface of the casing to lubricant-containing air, the rib being located radially opposite the groove when the lower aperture communicates with the fourth passageway to enable lubricant-containing air to flow through the groove and across the rib from the upper end of the recess to the lower end thereof, the lower portion of the piston arranged to travel downwardly into the central passageway of the bit-mounting structure and strike the anvil portion of the drill bit, with the downwardly facing surface of the upper portion of the piston spaced above the drill bit and the bit-mounting structure.

2. The drill according to claim 1 wherein the rib includes an outer face that constitutes an extension of a cylindrical surface of the piston.

3. The drill according to claim 2 wherein the piston includes a plurality of the recesses, the recesses spaced circumferentially apart.

4. A piston for use in a down-the-hole percussive drill, comprising:

an axial through-hole;

a first passageway extending downwardly from an upwardly facing surface of the piston and spaced radially inwardly from an outer peripheral side surface of the piston;

a second passageway extending upwardly from the downwardly facing surface of the upper portion of the piston, the second passageway defined by a recess formed in the outer peripheral surface side surface of the piston, an upper end of the recess spaced downwardly from the upwardly facing surface;

a third passageway extending from the axial through-hole to the outer peripheral side surface of the piston and intersecting a lower end of the first passageway; and a fourth passageway extending from the axial through-hole to the outer peripheral side surface of the piston and intersecting an upper end of the second passageway;

the outer peripheral side surface including a radially outwardly projecting rib situated between the upper end and a lower end of the recess.

5. The piston according to claim 4, wherein the rib includes an outer face that constitutes an extension of a cylindrical surface of the piston.

6. The drill according to claim 5, wherein the piston includes a plurality of the recesses, the recesses spaced circumferentially apart.

* * * * *